US006986434B1

(12) United States Patent
Getsy et al.

(10) Patent No.: US 6,986,434 B1
(45) Date of Patent: Jan. 17, 2006

(54) CONTAINER CLOSURE WITH HINGED LID

(75) Inventors: Stephen B. Getsy, Pittsburgh, PA (US); Gary L. Mengeu, Wheeling, WV (US); Frederick P. Minkemeyer, Rayland, OH (US); Dewey R. Carlile, Jr., Belmont, OH (US)

(73) Assignee: Silgan Plastics Corporation

( * ) Notice: Subject to any disclaimer, the term of this patent is extended or adjusted under 35 U.S.C. 154(b) by 0 days.

(21) Appl. No.: 10/205,020

(22) Filed: Jul. 25, 2002

(51) Int. Cl.
*B65D 43/16* (2006.01)
*B65D 43/22* (2006.01)
*B65D 43/24* (2006.01)

(52) U.S. Cl. ..... 220/254.3; 220/326; 220/832; 220/835

(58) Field of Classification Search ..... 220/254.3, 220/831, 832, 835, 259.1, 324, 326, 833, 220/839
See application file for complete search history.

(56) References Cited

U.S. PATENT DOCUMENTS 3,272,379 A * 9/1966 Driza et al. ..... 220/832
3,982,659 A 9/1976 Ross
4,158,902 A 6/1979 Chernack et al.
4,244,495 A * 1/1981 Lorscheid et al. ..... 222/153.14
4,325,492 A 4/1982 Kunze
4,349,120 A 9/1982 DiNardo
4,399,928 A * 8/1983 Klingler ..... 220/832
4,441,637 A 4/1984 Libit
4,535,912 A 8/1985 Bonk
4,625,898 A 12/1986 Hazard
4,795,065 A * 1/1989 Ashizawa et al. ..... 222/541.5
4,799,604 A * 1/1989 Okojima et al. ..... 220/260
4,887,747 A * 12/1989 Ostrowsky et al. ..... 222/556
4,901,882 A * 2/1990 Goncalves ..... 220/324
4,911,324 A 3/1990 Dubach
4,969,573 A * 11/1990 Dupuis et al. ..... 220/258.5
5,048,715 A 9/1991 Wolff
5,126,510 A * 6/1992 Bauer et al. ..... 174/52.1
5,150,806 A 9/1992 Glomski
5,247,265 A * 9/1993 Norimatsu ..... 331/16
5,271,536 A 12/1993 Wilson
5,353,946 A * 10/1994 Behrend ..... 220/326
5,358,130 A 10/1994 Mengeu et al.
5,405,007 A 4/1995 Iwahashi
5,526,953 A * 6/1996 Chieng ..... 220/4.23
5,577,779 A * 11/1996 Dangel ..... 292/80
6,092,690 A 7/2000 Bitowft et al.
6,269,970 B1 8/2001 Huang et al.
6,662,454 B2 * 12/2003 Harrold ..... 30/326

FOREIGN PATENT DOCUMENTS

FR 1306254 9/1962

* cited by examiner

*Primary Examiner*—Stephen K. Cronln
*Assistant Examiner*—Niki M. Eloshway

(57) ABSTRACT

The base part and lid part of a container closure joined by a living hinge have positioning members which engage to maintain the lid in a full open position or a partially open position short of the full open position. The positioning members flex to allow the lid part to be initially closed from an as-molded position beyond the full open position. A latch guide cams a latch into engagement to assure closure of the lid part.

16 Claims, 8 Drawing Sheets

CONTAINER CLOSURE WITH HINGED LID

BACKGROUND OF THE INVENTION

1. Field of the Invention

This invention relates to molded container closures with an integral lid joined to a base by a living hinge, and having the positioning members that fix the lid at a selectable position in a range of positions between a full open position and a closed position in which the lid is latched.

2. Background Information

Some containers are provided with a closure that includes a base part engaging the open top of the container and having an opening through which the contents of the container may be dispensed. These closures have a lid integrally molded with and connected to the base part by a living hinge. The living hinge is formed by a thin film of the resin material from which the closure is molded. When closed, the lid covers the dispensing opening. One such closure has integral straps that serve as springs to bias the lid either closed or open with a snap action. The open position is set with the lid about 90° to the base by abutment elements which project from the lid and the base. The closure is molded with the lid open 180°. The abutment elements are flexible and yield to allow the lid to be initially closed from the as-molded position. In use, the lid is toggled between the open (90°) position and the closed position by the spring straps.

Other closures have various arrangements for setting a similar open position, which may extend beyond the 90° position, such as to 135° open. While such closures serve specific purposes, there is room for improvement.

SUMMARY OF THE INVENTION

In accordance with the invention, a container closure has a base part and a lid part pivotally joined by a hinge which can be a living hinge. A lid positioner comprises on one of the base part and the lid part a first positioning member extending in a plane perpendicular to and laterally offset from the hinge axis and has adjacent a free end, a first stop surface. The lid positioner further includes on the other of the base part and the lid part a second positioning member also extending in the plane perpendicular to and laterally offset from the hinge axis. The second positioning member has a free end and a second stop surface which engages the stop surface on the first positioning member to set a selected full open position of the lid part. The second positioning member also has a contact surface which frictionally engages the first positioning member to retain the lid in a selected partially open position over an extended range of movement of the lid between the closed position and the full open position. At least one of the first and second positioning members is resilient to bias the contact surface into frictional contact with the second positioning member throughout the extended range of movement. Preferably, the one part from which the first positioning member extends is the base part and the other part is the lid part, in which case, the second positioning member preferably extends from the lid part and partially around the hinge axis with an outer surface facing away from the hinge axis forming the contact surface. The first stop surface on the first positioning member can be defined by a first hook projecting generally toward the hinge axis and the second stop surface on the second positioning member can be defined by a second hook projecting generally away from the hinge axis. When the container closure is molded with the lid part in a molded position in which the lid part is open beyond the full open position, these first and second hooks can have beveled heads which allow the first and second positioning members to cam past one another for closing from the molded position.

Preferably, the lid part has a latch projecting from the lid toward the base part and terminating in a latch bead that engages an undersurface on the base part along a latch edge. The base part has a guide member between the hinge axis and the latch facing toward the latch edge that cams the latch away from the hinge axis as the lid is closed to assure engagement of the latch bead with the undersurface of the base member. This undersurface on the base part can be accessible through a latch opening in the base part, in which case the guide member is adjacent this latch opening on the side toward the hinge axis, and may be in the form of a tongue projecting in the plane of the base member into the latch opening from the hinge side of the latch opening. The latch bead may be curved to follow the curvature of the skirt on the lid part and may engage either a linear or similarly curved latch edge. Alternatively, the latch bead may project toward the hinge axis and engage the tongue. Also, the latch bead can be bifurcated to provide flexibility in setting the retention force.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
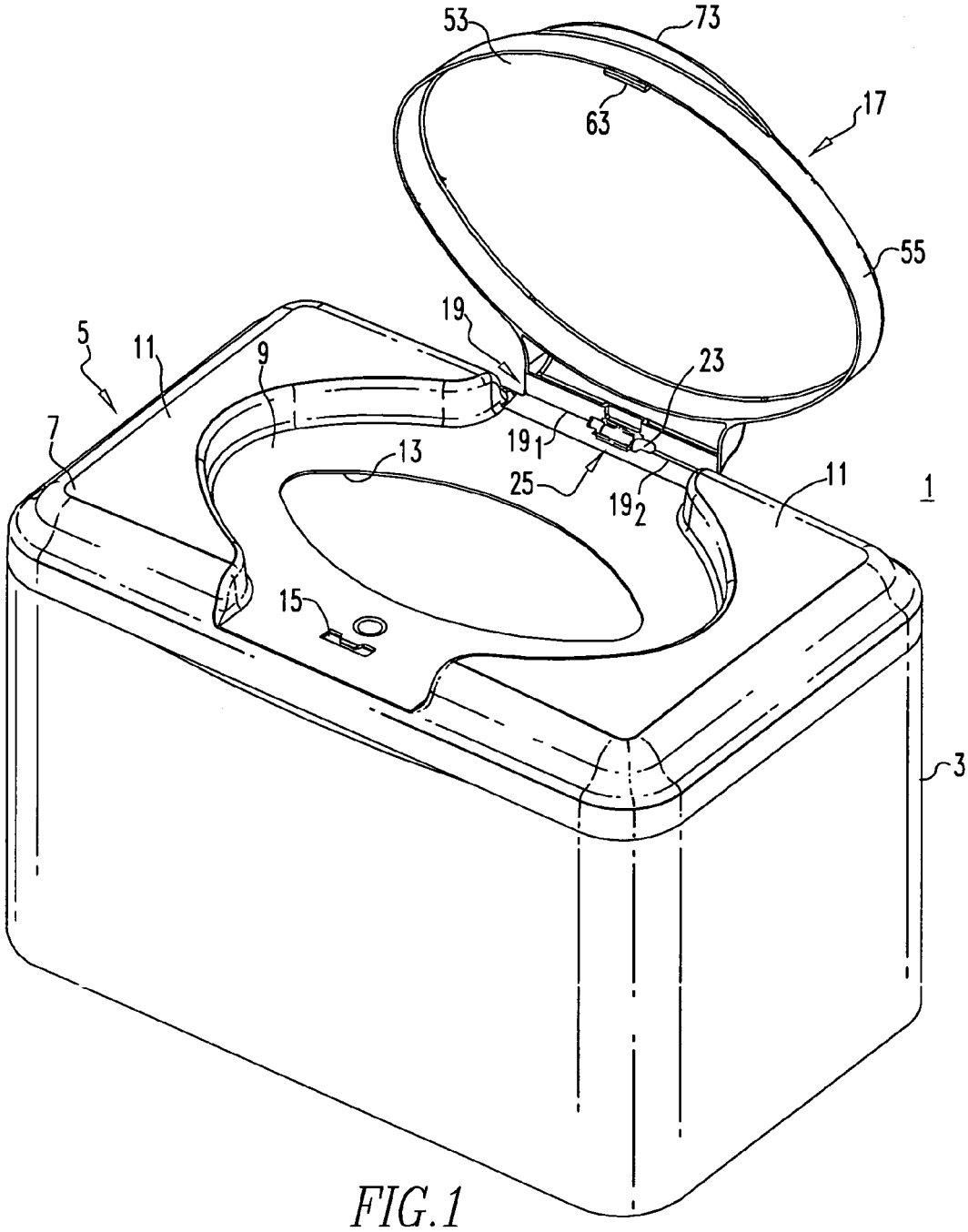
FIG. 1 is an isometric view of a dispensing package incorporating the invention and showing the lid of the closure in the full open position.

FIG. 1 shows a dispensing package 1 constituting a container 3 and a closure 5 in accordance with the invention. In the exemplary dispensing package 1, the closure is adapted for dispensing baby wipes, that is, moistened tissues. However, it will be appreciated that the closure in accordance with the invention has application to dispensing various types of products.

The closure 5 has a base part 7 which snaps onto the container 3 in a conventional manner. This base part 7 has a planer, generally elliptically shaped center section 9 between two raised end sections 11. The center section 9 has a dispensing opening 13 through which product stored in the container 3 may be dispensed. In the exemplary closure 5, this dispensing opening is elliptical, but may assume any manner of shapes as the configuration of the dispensing opening is not essential to the present invention. This center section 9 of the base part 7 also has a latch opening 15 which will be described below in greater detail.

The closure 5 has in addition to the base part 7 a lid part 17 joined to the base part by a hinge 19. Preferably, the base part 7 and lid part 17 are integrally molded and the hinge 19 is a living hinge. The lid part 17 can be pivoted about the hinge axis 21 of the living hinge 19 shown in FIG. 2 between open and closed positions shown in FIGS. 5 and 4, respectively. The living hinge 19 is divided into two sections $\mathbf{19}_1$ and $\mathbf{19}_2$ by a gap 23 in which a lid positioner 25 is provided.

Figure 2:
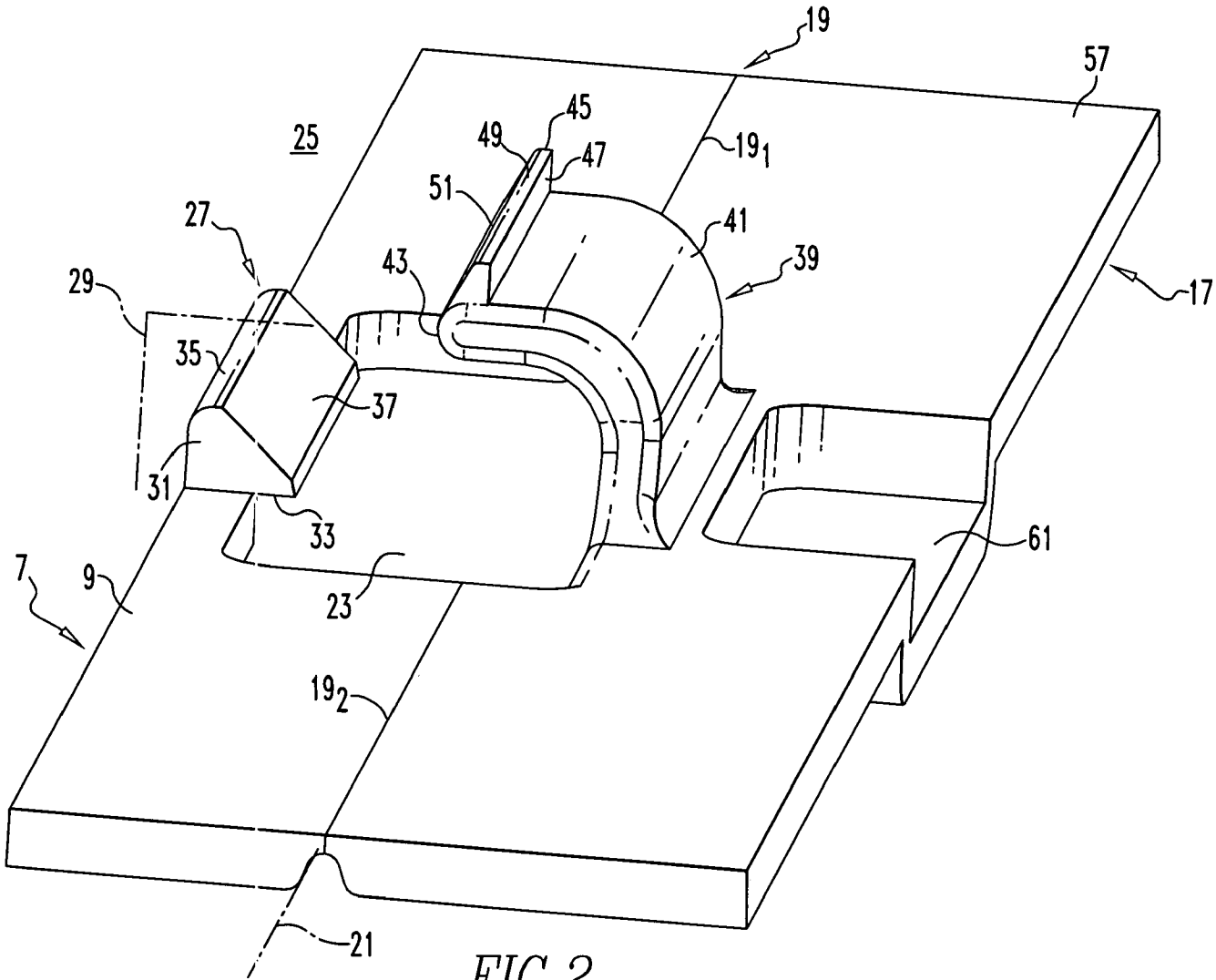
FIG. 2 is a fragmentary isometric view illustrating the relationship of the lid and base part of the closure of the invention shown in the "as-molded" position.

The lid positioner 25 includes a first positioning member 27 integrally molded to extend from the center section 9 of the base part 7 in a plane 29 generally perpendicular to the hinge axis 21 and off-set laterally from the hinge axis as shown particularly in FIG. 2. This first positioning member 27 defines a first hook 31 projecting generally toward the hinge axis 21, and forming a first stop surface 33. The head 35 of this first hook 31 is beveled to form the inclined surface 37.

The lid positioner 25 also includes a second positioning member 39 projecting from the lid part 17 also in the plane 29 and also laterally offset from the hinge axis 21. This second positioning member 39 extends partially around the hinge axis to define a contact surface 41 facing away from the hinge axis 21. The second positioning member has adjacent a free end 43, a second hook 45 projecting away from the hinge axis 21, and defining a second stop surface 47. This second hook 45 also has a beveled head 49 forming the inclined surface 51.

Figure 7:
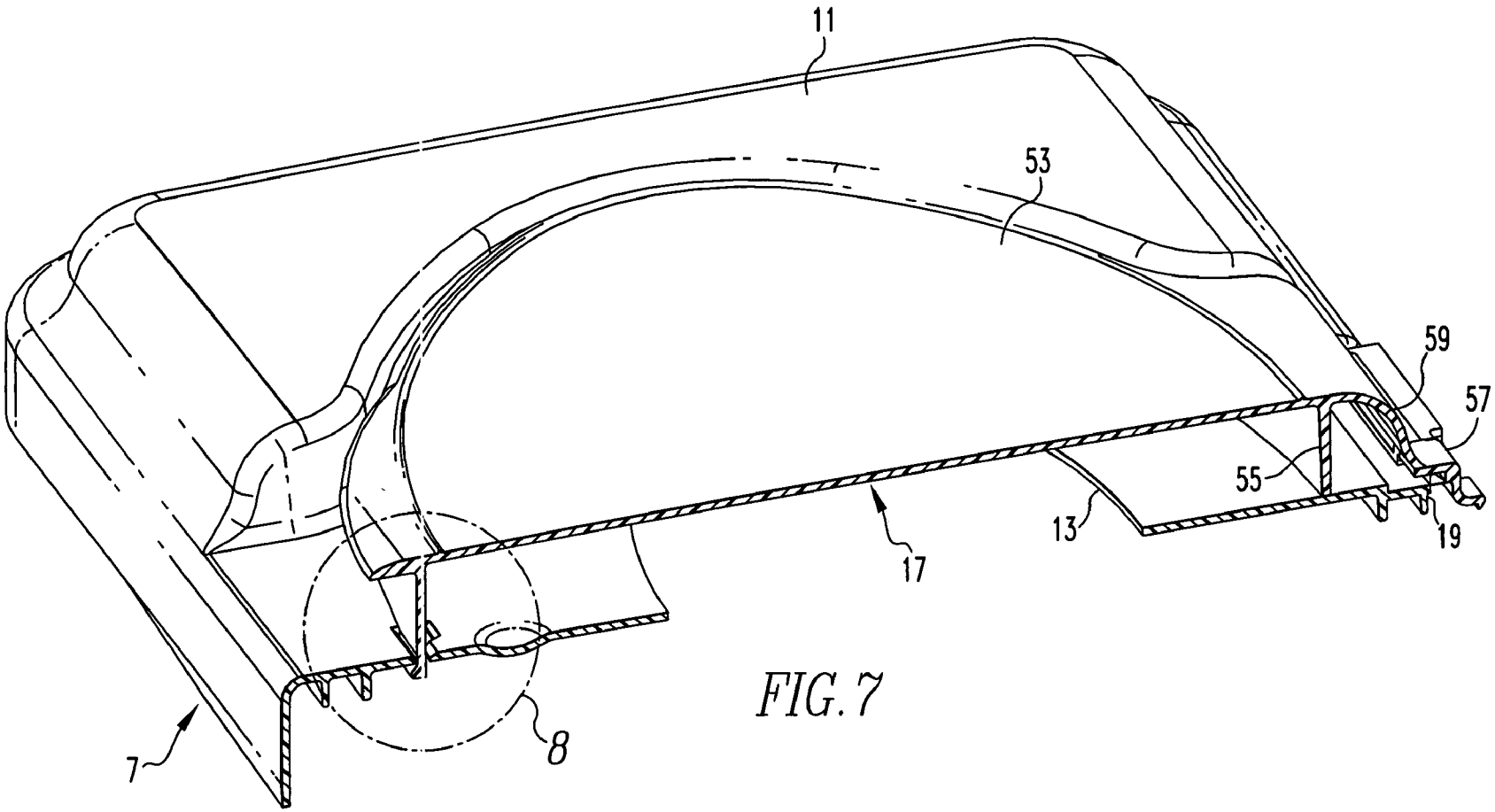
FIG. 7 is an isometric view in section of the closure with the lid fully closed.

As best seen in FIG. 7, the lid part 17 of the closure 5 has a planar section 53 bounded by a skirt 55 which is sized to be received in the base part 7 between the two end sections 11 so that with the lid part 17 closed, the planar section 53 is co-planar with the upper surface of the end sections 11 of the base part 7.

The lid part 17 has a thin root section 57 adjacent the living hinge 19 and a transition section 59 between this root section and the planar section 53 that matches the contour of the raised end sections 11 of the base part 7, which are set back from the periphery of the base. This root section 57 has an integrally molded pocket 61 (see FIG. 2) which accommodates the first positioning member 27 when the lid part 17 is fully closed (see FIG. 4).

The closure 5 is molded with the lid part 17 open 180°, that is with the root section 57 co-planar with the planar center section 9 of the base part as shown in the fragmentary view of FIG. 2. During initial closing of the lid part 17 from the as-molded position shown in FIG. 2, the first and second positioning members 27 and 39 interfere with one another. However, the inclined surface 37 on the beveled head 35 of the first positioning member 27 and the corresponding inclined surface 51 on the beveled 49 of the second positioning member 39 engage and deflect the first positioning member 27 and the second positioning member 39 away from each other so that the lid 17 can close to the fully closed position shown in the fragmentary sectional view of FIG. 4 and in FIG. 7.

Figure 8:
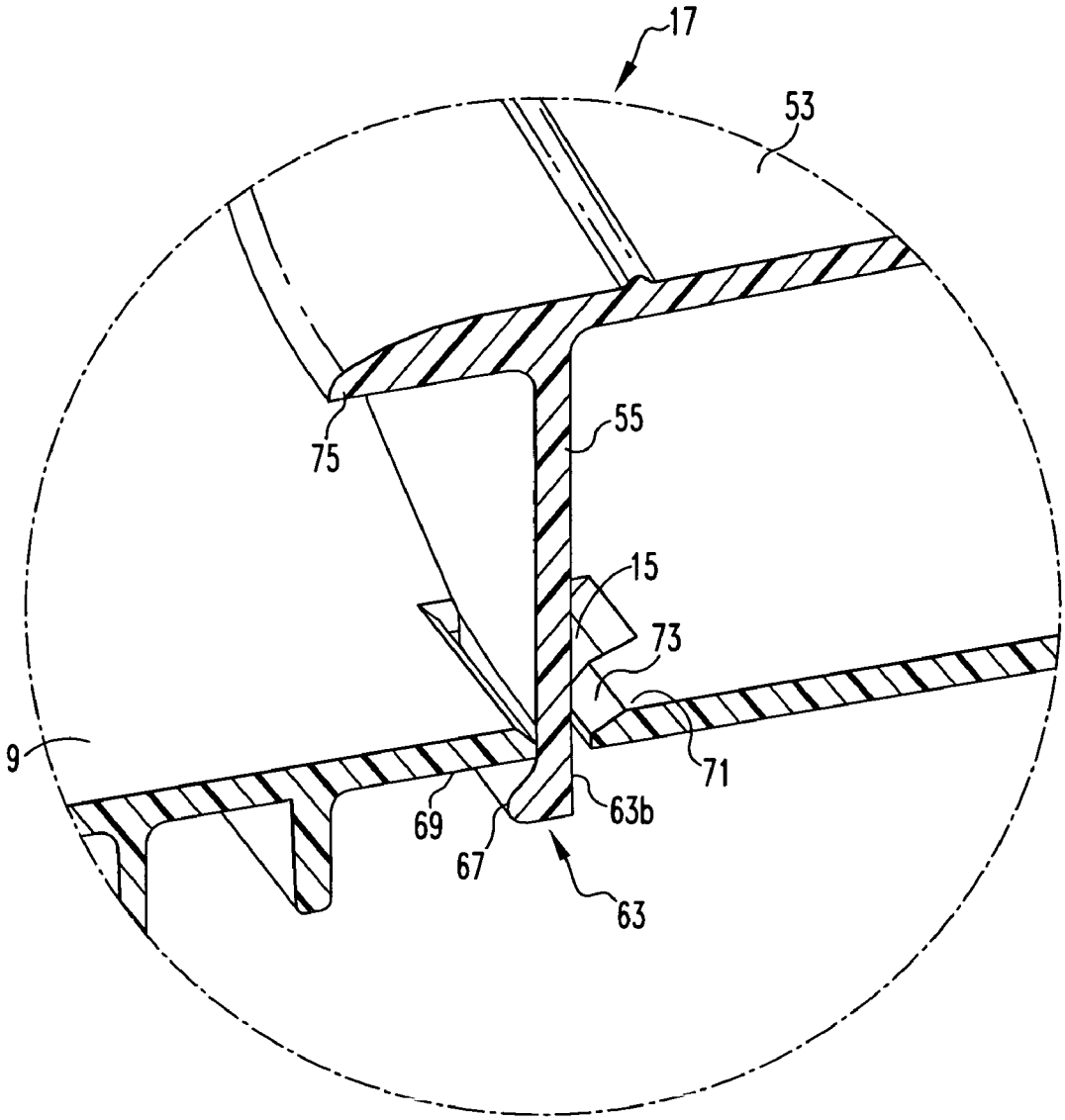
FIG. 8 is an enlargement of the encircled portion of FIG. 7.

Referring to FIG. 8, the lid part 17 is retained in the closed position by a latch 63 projecting downward from the front edge of the skirt 55 on the lid part 17. This latch projects downward through the latch opening 15 in the planar center section 9 of the base part 7 and has an outwardly facing latch hook formed by a bead 67 which engages an undersurface 69 on the planar center section 9 of the base part 7. In order to assure engagement of the latch hook 67, a guide member 71 in the form of a tongue, extending into the latch opening 15 from the side toward the hinge axis 19 has an inclined guide surface 73 which cams the latch 63 away from the hinge axis 19. The guide member 71 reduces the width of the latch opening 15 at a central portion to a distance at least less than the width of the latch bead 67 and even less than the width of a base portion **63*b* that extends downward from the skirt 55. This creates an interference which assures retention of the lid part 17 in the closed position. The guide member 71 and the planar center section 9 of the base part 7 adjacent the latch opening 15 are thin enough, and therefore flexible enough, to deflect to allow engagement and disengagement of the latch hook 67**.

Figure 5:
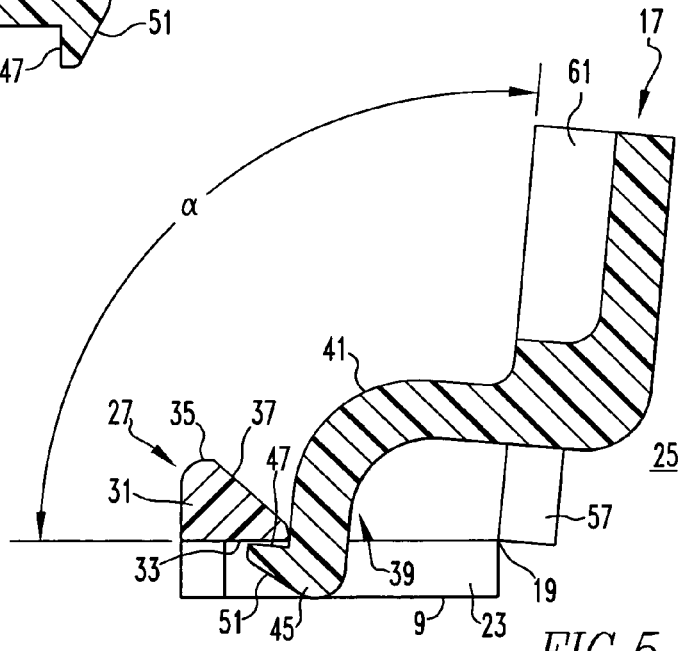
FIG. 5 is a fragmentary sectional view of the closure in the full open position.

The lid part 17 is opened by engaging the overhanging brow 75 on the front of the lid part and rotating it upward about the living hinge 19. A full open position of the lid part 17 is set by the lid positioner 25 when the stop surfaces 33 and 47 on the first positioning member 27 and second positioning member 39, respectively, engage as shown in FIG. 5. This full open position, angle $\alpha$, can be set as desired, such as between about 60° to about 145° from the fully closed position. As the lid part 17 is molded in the 180° open position, the set of the resin tends to bias the lid toward the full open position.

Figure 3:
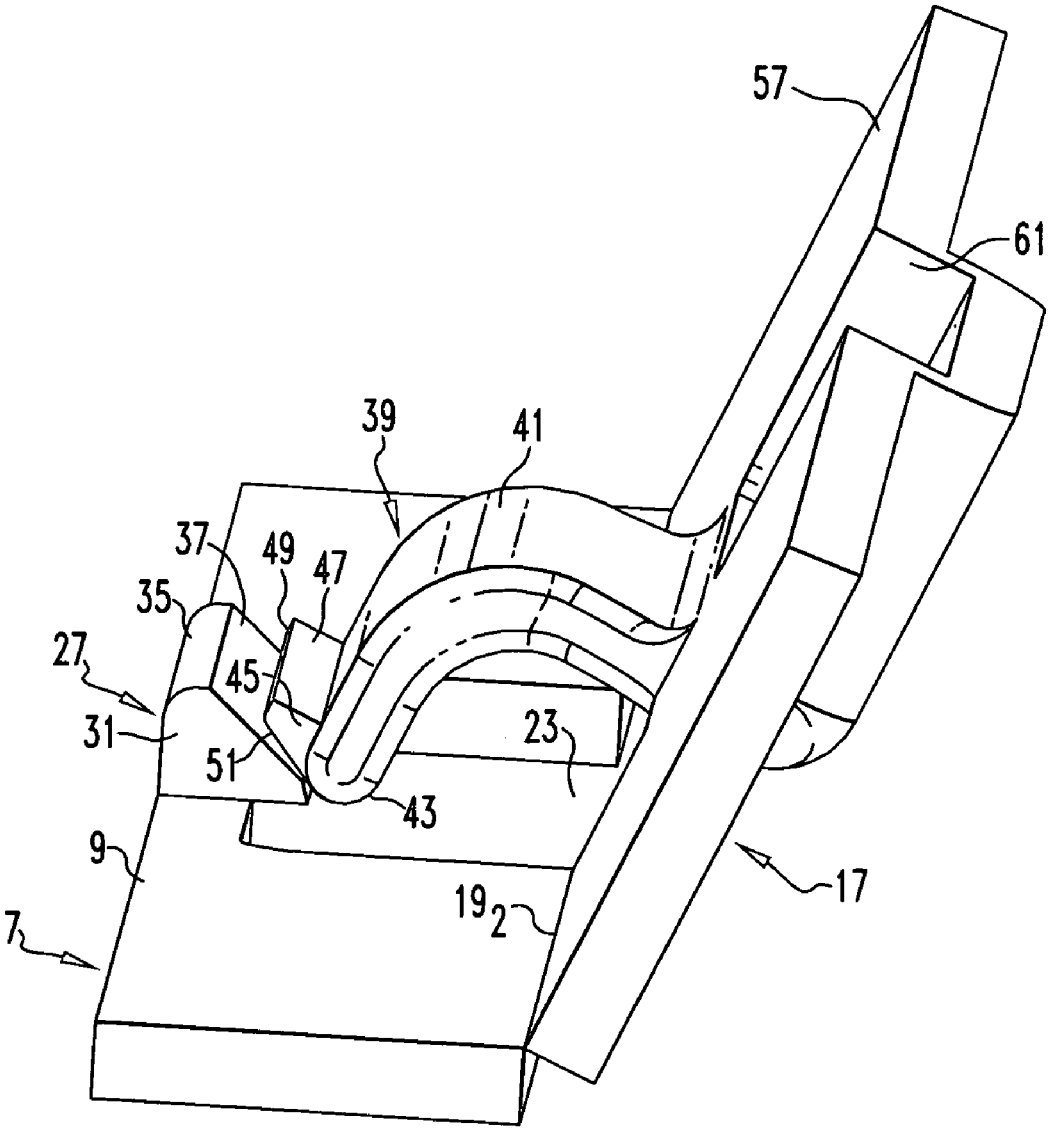
FIG. 3 is a fragmentary isometric view during initial closing of the lid from the as-molded position of FIG. 2.
Figure 4:
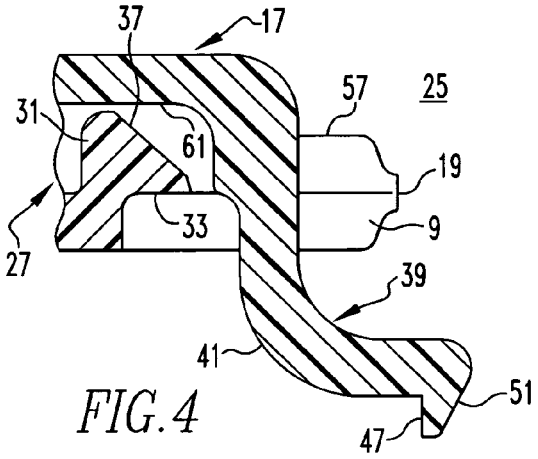
FIG. 4 is a fragmentary sectional view of the closure in the fully closed position.
Figure 6:
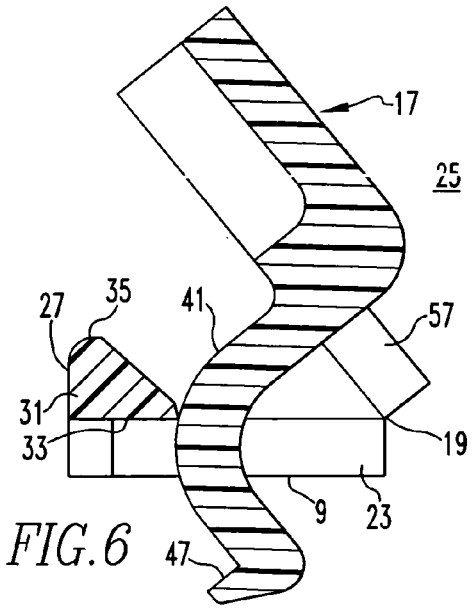
FIG. 6 is a fragmentary sectional view of the closure in a partially open position.

The lid part 17 can be selectively set at other positions by the lid positioner 25 between the full closed position of FIG. 4 and the full open position of FIG. 5. As seen in FIG. 6, the outer contact surface 41 on the second positioning member 39 is frictionally engaged by the hook 31 on the first positioning member so that the lid part 17 can be set over an extended range of positions up to the full open position. Preferably, as can be seen in FIG. 3, the hook 31 does not engage the contact surface 41 near the fully closed position which allows the lid part 17 to be pulled forward to ensure engagement of the latch.

Figure 9:
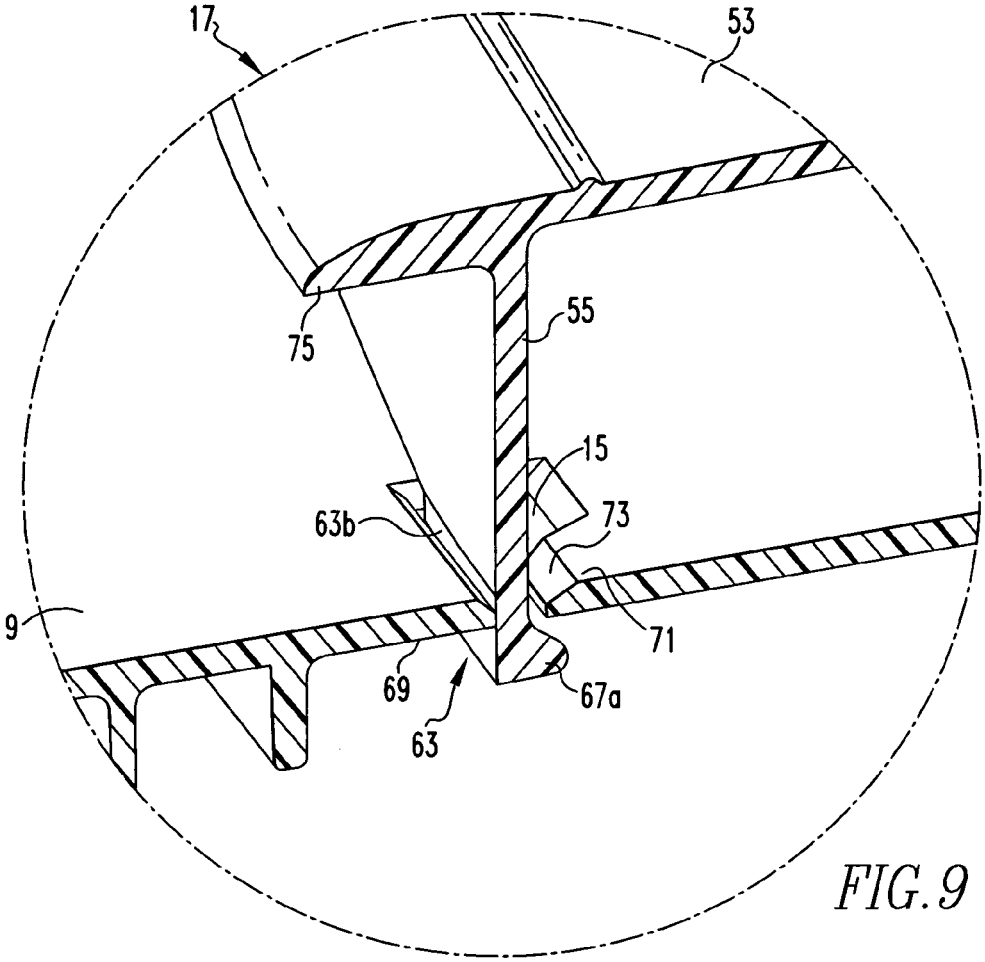
FIG. 9 is similar to FIG. 8 but shows another embodiment of the invention in which the direction of the latch bead is reversed.

In an alternative arrangement shown in FIG. 9, the latch hook or bead **67*a* extends toward the hinge axis 21 and engages the guide member or tongue 71, to retain the lid part 17** in the closed position.

Figure 10:
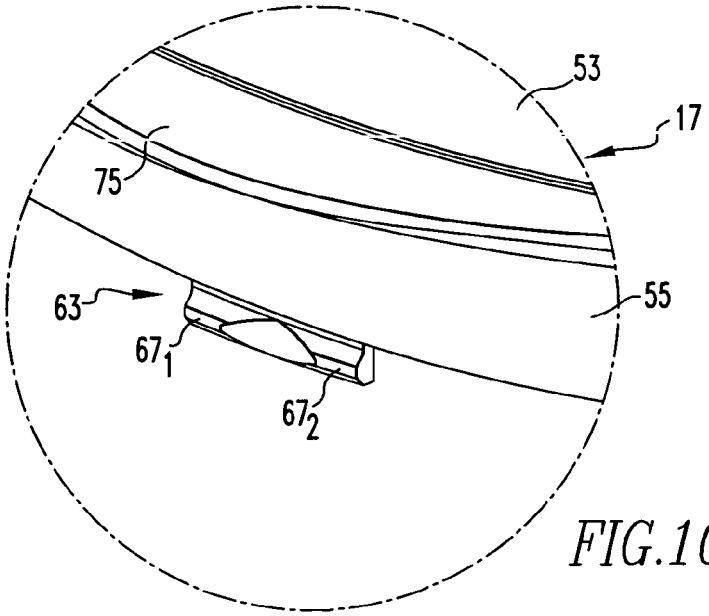
FIG. 10 is a fragmentary isometric view of an alternative embodiment in which the latch bead of the closure is bifurcated.

Other alternate embodiments of the latch 63 include a bead **67*b* that is interrupted to form two spaced apart bead sections $\mathbf{67}_1$ and $\mathbf{67}_2$ as shown in FIG. 10**. Use of the interrupted bead provides a means of adjusting the retention force of the latch, and therefore also, the opening force required to unlatch the lid part.

Figure 11:
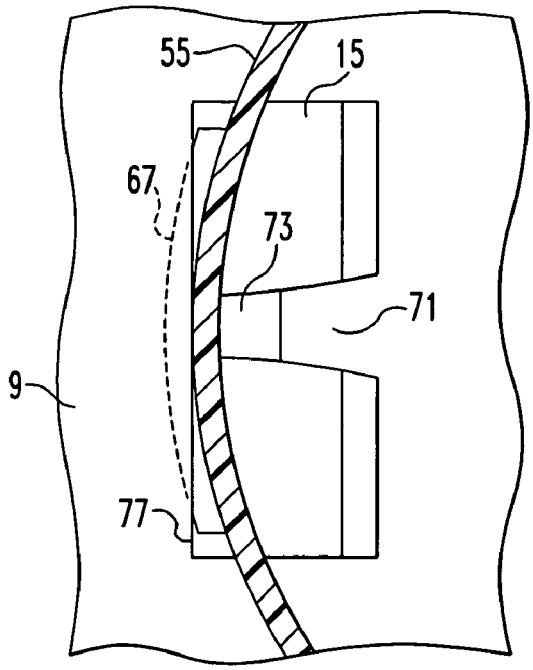
FIG. 11 is a fragmentary sectional view taken just above the base part of another embodiment in which the curved latch bead engages a substantially linear latch edge.

As is evident from FIG. 1, the skirt 55 is curved about its direction of projection from the lid part. The latch bead 67 can conform to this same curvature, and as illustrated in FIG. 11, which is a fragmentary sectional view taken just above the base part with the lid part latched, the latch edge 77 can be linear so that only the center of the latch bead engages the latch edge. Again, this is a technique for achieving a desired retention force.

Figure 12:
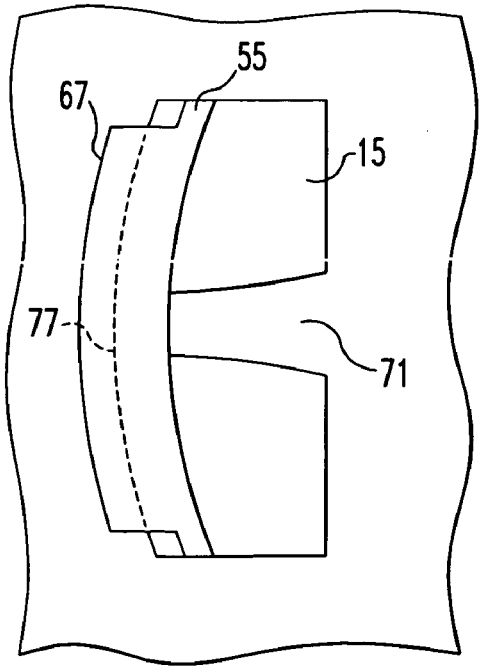
FIG. 12 is a fragmentary bottom plan view of yet another embodiment in which the latch edge is curved to match the curved latch bead.

In still another embodiment illustrated in the view from the underside of the latch that is FIG. 12, the latch edge 77' can be curved to match the curvature of the latch bead, thereby providing extended engagement of the latch bead with the latch edge.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A container closure comprising:

a base part having a dispensing opening and a lid part pivotally joined to the base part by a hinge along a hinge axis, the lid part being rotatable about the hinge axis to a closed position covering the dispensing opening, and a lid positioner comprising on the base part a first positioning member extending from the base part in a plane perpendicular to the hinge axis and offset laterally from the hinge axis and having adjacent a first free end, a first stop surface, formed by a first hook projecting generally toward the hinge axis, and on the lid part, a second positioning member extending from the lid part in the plane perpendicular to the hinge axis and offset laterally from and extending partially around the hinge axis and having adjacent a second free end, a second stop surface formed by a second hook projecting generally away from the hinge axis facing and engaging the first stop surface to set a selected full open position of the lid part, the second positioning member having an outer surface facing away from the hinge axis forming a contact surface which frictionally engages the first positioning member over an extended range of movement of the lid part between the closed position and the selected full open position to retain the lid part in any selected partially open position over the extended range of movement, wherein at least one of the first and second positioning members is resilient to bias the contact surface on the second positioning member into frictional contact with the first positioning member during movement of the lid part over the extended range of movement.

2. The container closure of claim 1, wherein the hinge is a living hinge joining the base part and lid part and the container closure is molded with the lid part in a molded position in which the lid part is open beyond the full open position and wherein the first hook and the second hook have beveled heads which allow the first and second positioning members to cam past one another for closing from the molded position.

3. The container closure of claim 2, wherein the lid part has a latch projecting from the lid part toward the base part and terminating in a latch hook projecting away from the hinge axis and which engages an undersurface of the base part, the base part having a guide member between the hinge axis and the undersurface camming the latch away from the hinge axis to assure engagement of the latch hook with the undersurface of the base member.

4. The container closure of claim 2, wherein the undersurface of the base part is accessible through an opening in the base part, and the guide member has a guide surface leading toward the undersurface that is engaged by the latch.

5. The container closure of claim 1, wherein the lid part includes a pocket into which the first positioning member extends when the lid part is in the closed position.

6. The container closure of claim 1, wherein the lid part has a latch projecting toward the base part and terminating in a latch hook projecting away from the hinge axis and which engages an undersurface of the base part, the base part having a guide member between the hinge axis and the undersurface camming the latch away from the hinge axis to assure engagement of the latch hook with the undersurface of the base member.

7. The container closure of claim 6, wherein the undersurface of the base part is accessible through a latch opening in the base part, and the guide member has a guide surface leading toward the undersurface that is engaged by the latch.

8. The container closure of claim 7, wherein the guide member is a tongue projecting in a plane of the base member into the latch opening from the hinge side of the latch opening, and the guide surface is an inclined surface on a free end of the tongue.

9. A container closure comprising:

a base part having a dispensing opening and a lid part pivotally joined to the base part by a hinge along a hinge axis, the lid part being rotatable about the hinge axis to a closed position covering the dispensing opening, the lid part further having a latch projecting toward the base pa to latch the lid in the closed position, the base part having a latch open defining a latch edge facing the hinge axis and a flexible tongue cantilevered in a direction away from the hinge axis across the latch opening toward the latch edge a distance to create interference with the latch and guide the latch between the latch edge and the free end of the tongue and into engagement with the latch edge; and cooperating lid positioning members on said base and lid parts including a first positioning member extending from the base part in a plane perpendicular to the hinge axis and offset laterally from the hinge axis, a second positioning member extending from the lid part in the plane perpendicular to the hinge axis and offset laterally from and extending partially around the hinge axis, at least one of the first and second positioning members being resilient to bias a contact surface thereon into frictional contact with the other positioning member during movement of the lid part over and extended range of movement.

10. The container closure of claim 9, wherein the tongue has an inclined guide surface on a free end guiding the latch between the latch edge and the tongue.

11. The container closure of claim 9, wherein the latch includes a latch bead that engages under the base part.

12. The container closure of claim 11, wherein the bead is interrupted to form spaced apart bead sections.

13. The container closure of claim 11, wherein the bead projects toward the hinge axis and engages under the free end of the tongue.

14. The container closure of claim 11, wherein the bead projects away from the hinge axis and engages under the latch edge.

15. The container closure of claim 9, wherein the latch edge is substantially linear, the lid has a skirt projecting toward the base part and curved about the direction of projection and the latch projects from the skirt and is linear and extends substantially parallel to the linear latch edge.

16. The container closure of claim 9, wherein the latching edge is substantially linear wherein the lid has a skirt projecting toward the base part and curved about the direction of projection and the latch projects from the skirt the latch having a bead projecting away from the hinge axis and curved with the skirt, the bead engaging the base part under the latch edge.

* * * * *